US012781297B2

(12) United States Patent
Murray

(10) Patent No.: US 12,781,297 B2
(45) Date of Patent: Nov. 3, 2026

(54) METHOD AND SYSTEM FOR PRODUCING DIRECT REDUCED METAL

(71) Applicant: GREENIRON H2 AB, Stockholm (SE)

(72) Inventor: Hans Murray, Djursholm (SE)

(73) Assignee: GREENIRON H2 AB, Stockholm (SE)

( * ) Notice: Subject to any disclaimer, the term of this patent is extended or adjusted under 35 U.S.C. 154(b) by 411 days.

(21) Appl. No.: 18/281,615

(22) PCT Filed: Mar. 4, 2022

(86) PCT No.: PCT/SE2022/050213
§ 371 (c)(1),
(2) Date: Sep. 12, 2023

(87) PCT Pub. No.: WO2022/191754
PCT Pub. Date: Sep. 15, 2022

(65) Prior Publication Data

US 2024/0150859 A1 May 9, 2024

(30) Foreign Application Priority Data

Mar. 12, 2021 (SE) ..... 2150290-1

(51) Int. Cl.
*C21B 13/00* (2006.01)

(52) U.S. Cl.
CPC ..... *C21B 13/0073* (2013.01); *C21B 13/004* (2013.01); *C21B 2100/64* (2017.05); *C21B 2100/66* (2017.05)

(58) Field of Classification Search
CPC ..... C21B 13/0073; C21B 13/004; C21B 2100/64; C21B 2100/66; C23C 8/20; C22B 5/12; Y02P 10/134; Y02P 10/25
(Continued)

(56) References Cited

U.S. PATENT DOCUMENTS 3,964,898 A * 6/1976 Murray ..... C21B 13/0073 75/10.39
4,089,681 A 5/1978 Gueussier
(Continued)

FOREIGN PATENT DOCUMENTS

CN 1383453 A 12/2002
CN 102232119 A 11/2011
(Continued)

OTHER PUBLICATIONS

Extended European Search Report from corresponding European Application No. 22767596.4, mailed on Jun. 26, 2024, 8 pages.
(Continued)

*Primary Examiner* — Jessee R Roe
*Assistant Examiner* — Michael Aboagye
(74) *Attorney, Agent, or Firm* — Tucker Ellis LLP

(57) ABSTRACT

Method for producing direct reduced metal material (106) in a continuous process, wherein hydrogen gas and inert gas is circulated in respective closed-loop first and second gas circuits via different respective gas connection stations (130, 140120-122,150-151), comprising for individual mobile furnaces (101): a) charging metal material (106) into the furnace; b) moving and connecting the furnace to an inert gas connection station; c) providing heated inert gas to the furnace; d) disconnecting the furnace; e) moving and connecting the furnace to a hydrogen gas connection station; f) providing heated hydrogen gas to the furnace; g) disconnecting the furnace; h) moving and connecting the furnace to an inert gas connection station; i) providing cooled inert gas to the furnace; j) disconnecting the furnace; and k) discharging the metal material. The invention also relates to a system.

17 Claims, 7 Drawing Sheets

(58) Field of Classification Search
USPC ..... 75/484
See application file for complete search history.

(56) References Cited

U.S. PATENT DOCUMENTS

| | | | | |
|---|---|---|---|---|
| 4,150,972 | A | 4/1979 | Price-Falcon et al. | |
| 4,160,663 | A * | 7/1979 | Hsieh | C21B 13/02 75/495 |
| 4,216,011 | A * | 8/1980 | Martinez Vera | C21B 13/0073 266/156 |
| 5,542,963 | A | 8/1996 | Sherwood | |
| 5,545,251 | A * | 8/1996 | Knop | B01J 8/26 266/172 |
| 5,885,325 | A | 3/1999 | Geiger et al. | |
| 5,897,829 | A | 4/1999 | Kim et al. | |
| 6,569,220 | B1 * | 5/2003 | Clark | B22F 9/22 75/255 |
| 8,915,352 | B2 * | 12/2014 | Tsuge | C21B 13/10 198/562 |
| 2020/0048724 | A1 | 2/2020 | Green et al. | |
| 2020/0385827 | A1 | 12/2020 | Astoria | |
| 2022/0010405 | A1 | 1/2022 | Murray | |
| 2023/0002841 | A1 | 1/2023 | Murray | |
| 2023/0235418 | A1 | 7/2023 | Murray | |
| 2024/0150859 | A1 | 5/2024 | Murray | |

FOREIGN PATENT DOCUMENTS

| | | | |
|---|---|---|---|
| CN | 102443668 | A | 5/2012 |
| CN | 107217155 | A | 9/2017 |
| CN | 107227385 | A | 10/2017 |
| CN | 109971906 | A | 7/2019 |
| CN | 111270037 | A | 6/2020 |
| CN | 111440914 | A | 7/2020 |
| CN | 111575428 | A | 8/2020 |
| CN | 112410493 | A | 2/2021 |
| JP | S54126618 | A | 10/1979 |
| JP | S59104410 | A | 6/1984 |
| JP | S63140011 | A | 6/1988 |
| JP | H07150211 | A | 6/1995 |
| JP | 2017226893 | A | 12/2017 |
| SE | 7406174-8 | | 8/1979 |
| SE | 2050356 | A1 | 10/2020 |
| WO | 2000049184 | A1 | 8/2000 |
| WO | 2011012964 | A2 | 2/2011 |

OTHER PUBLICATIONS

Office action from corresponding Russian Application No. 2023125309/05 dated Jun. 30, 2025, 16 pages with translation.
Office action from corresponding Application No. 2020356139 dated Jul. 11, 2025, 3 pages.
Office action from corresponding Application No. 2021800454163 dated Aug. 1, 2025, 15 pages with translation.
Office action from corresponding Application No. 202280021007.4 dated Aug. 16, 2025, 17 pages with translation.
Indonesian Office Action from corresponding Application No. P00202214836 mailed on Oct. 30, 2025, 6 pages with translation.
Korean Office Action from corresponding Application No. 10-2023-7001056 mailed on Dec. 3, 2025, 16 pages with translation.
South African Written Opinion and Search Report from corresponding Application No. ZA2024/08872 mailed on Jan. 12, 2026, 9 pages.
International Search Report from corresponding International Application No. PCT/SE2022/050213, mailed on Apr. 8, 2022, 4 pages.
Japanese Office action from corresponding Application No. 2023-555149, dated Sep. 8, 2025, 2 pages with translation.
"Administrative Nullity of Patent No. BR 11 2022 026372 4", dated Oct. 13, 2025, 69 pages.
Mexican Office action from corresponding Application No. MX/a/2022/003493, dated Sep. 26, 2025, 8 pages with translation.
Indian Office action from corresponding Application No. 202217021819, dated Nov. 21, 2025, 6 pages with translation.
Office Action from corresponding Application No. P00202308289 in Indonesia, dated Nov. 12, 2025, 6 pages with translation.
Brazilian Office action from corresponding Application No. BR1120210192980, dated Feb. 11, 2025, 3 pages.
Australian Office action from corresponding Application No. 2020253206, dated Feb. 26, 2025, 4 pages.
Canadian Office action from corresponding Application No. 3173013, dated Mar. 3, 2025, 4 pages.
Brazilian Office action from corresponding Application No. BR1120210193030, dated Mar. 11, 2025, 3 pages.
Chinese Office action from corresponding Application No. 2021800454163, dated Mar. 18, 2025, 15 pages with translation.
Russian Office action from corresponding Application No. 2022134629, dated Mar. 28, 2025, 9 pages with translation.
Brazilian Office action from corresponding Application No. BR1120220041896, dated Apr. 15, 2025, 2 pages.
Chilean Office Action from corresponding Application No. 202203724, dated Apr. 7, 2025, 30 pages with translation.
Office action from corresponding U.S. Appl. No. 18/864,429, dated May 1, 2025, 24 pages.
Korean Office Action from corresponding Application No. 10-2022-7009513, dated May 19, 2025, 19 pages with translation.
Japanese Office Action from corresponding Application No. 2022-578971, dated Jun. 3, 2025, 14 pages with translation.
Hernandez-Gomez, Roberto, et al., "Accurate Experimental (p. p. T) Data for the Introduction of Hydrogen into the Natural Gas Grid: Thermodynamic Characterization of the Nitrogen-Hydrogen Binary System from 240 to 350 K and Pressures up to 20 MPa", Journal of Chemical Engineering Data, (2017), pp. 4310-4326.
Russian Office action from corresponding Application No. 2023125309 dated Nov. 28, 2025, 10 pages with translation.
European Search Report from corresponding Application No. 23808007.1 dated Jan. 21, 2026, 11 pages.
Office action from corresponding U.S. Appl. No. 18/864,429 dated Mar. 4, 2026, 39 pages.
Office action from corresponding Chinese Application No. 2022800210074 dated Mar. 27, 2026, 10 pages.
Office action from corresponding Chile Application No. 202403514 dated Apr. 9, 2026, 17 pages.
Office action from corresponding Ukraine Application No. 202300090 dated May 8, 2026, 7 pages.
Examination report issued Jul. 7, 2026 in corresponding Canadian patent application No. 3,181,684, 5 pages.
Notice of appeal issued Jul. 13 in corresponding Swedish Application No. 2050771-1, 22 pages. Year not provided.
Examination report issued Jul. 15 in corresponding Australian patent application No. 2021296994, 4 pages. Year not provided.
Final rejection issued Jul. 30 in corresponding Chinese patent application No. 2022800210074, 10 pages. Year not provided.
Examination report issued Aug. 17, 2026 in corresponding Indian patent application No. 202317004581, 14 pages with translation.

* cited by examiner

METHOD AND SYSTEM FOR PRODUCING DIRECT REDUCED METAL

The present invention relates to a method and a system for producing direct reduced metal, and in particular direct reduced iron (also known as sponge iron) but with very low contents of carbon. In particular, the present invention relates to the direct reduction of metal ore and metal oxides under a controlled hydrogen atmosphere to produce such direct reduced metal. The invention can further be used to produce carburised such direct reduced metal, by the provision of a carbon-containing gas as a part of the same process, for carburizing the reduced metal material.

The production of direct reduced metal using hydrogen as a reducing agent is well-known as such. For instance, in SE7406174-8, SE7406175-5 and methods are described in which a charge of metal ore is subjected to a hydrogen atmosphere flowing past the charge, which as a result is reduced to form direct reduced pure metal.

Furthermore, in Swedish published application SE1950403-4, and further in Swedish applications SE1951070-0 and SE2050771-1 that have not been published at the priority date of the present application, processes for direct reducing metal material under a closed hydrogen atmosphere, and further to carburise such direct reduced metal material, are disclosed.

The present invention provides a way to perform such reduction and possible carburisation on a larger scale.

Specifically, these prior methods work well for batch-wise production of direct-reduced metal. In order to increase production, several smaller furnaces can be used in parallel. Also, the production can be automated to large extent, as is described in said Swedish patent applications.

However, with the scaling up of production in mind, there is a need for a more easily scalable, flexible and robust way to achieve such direct reduction of metal material. Such a process should be fully automatable and arranged to handle shifting temporary or permanent output requirements at low cost.

The present invention solves the above described problems.

Hence, the invention relates to a method for producing direct reduced metal material in a continuous process, the method comprising circulating hydrogen gas in a closed-loop first gas circuit by, using a first valve system, selectively circulate hydrogen gas via one or several of a set of several hydrogen gas connection stations, the method further comprising circulating an inert gas in a closed-loop second gas circuit by, using a second valve system, selectively circulate inert gas via one or several of a set of several inert gas connection stations, the method further comprising the following steps, performed for each of a plurality of individual mobile furnaces: a) charging an amount of metal material to be reduced into the mobile furnace; b) moving the mobile furnace to, and connecting the mobile furnace to, a first one of said inert gas connection stations; c) providing heated inert gas to the mobile furnace so that the metal material is heated by the heated inert gas circulating past the metal material inside the mobile furnace; d) disconnecting the mobile furnace from said first inert gas connection station; e) moving the mobile furnace to, and connecting the mobile furnace to, a first one of said hydrogen gas connection stations; f) providing heated hydrogen gas to the mobile furnace so that the metal material is reduced by the heated hydrogen gas circulating past the metal material inside the mobile furnace; g) disconnecting the mobile furnace from said first hydrogen gas connection station; h) moving the mobile furnace to, and connecting the mobile furnace to, a second one of said inert gas connection stations; i) providing cooled inert gas to the mobile furnace so that the metal material is cooled by the cooled inert gas circulating past the metal material inside the mobile furnace; j) disconnecting the mobile furnace from said second inert gas connection station; and k) discharging the reduced and cooled metal material from the mobile furnace.

The invention also relates to a system for producing direct reduced metal material in a continuous process, the system comprising circulation means for circulating hydrogen gas in a closed-loop first gas circuit, the system comprising a first valve system, arranged to selectively circulate hydrogen gas via one or several of a set of several hydrogen gas connection stations comprised in the system, the system further comprising circulation means, arranged to circulate an inert gas in a closed-loop second gas circuit, the system comprising a second valve system, arranged to selectively circulate inert gas via one or several of a set of several inert gas connection stations comprised in the system, the system further comprising a plurality of individual mobile furnaces, the system being arranged to: a) charge an amount of metal material to be reduced into a mobile furnace; b) move the mobile furnace to, and connect the mobile furnace to, a first one of said inert gas connection stations; c) provide heated inert gas to the mobile furnace so that the metal material is heated by the heated inert gas circulating past the metal material inside the mobile furnace; d) disconnect the mobile furnace from said first inert gas connection station; e) move the mobile furnace to, and connecting the mobile furnace to, a first one of said hydrogen gas connection stations; f) provide heated hydrogen gas to the mobile furnace so that the metal material is reduced by the heated hydrogen gas circulating past the metal material inside the mobile furnace; g) disconnect the mobile furnace from said first hydrogen gas connection station; h) move the mobile furnace to, and connecting the mobile furnace to, a second one of said inert gas connection stations; i) provide cooled inert gas to the mobile furnace so that the metal material is cooled by the cooled inert gas circulating past the metal material inside the mobile furnace; j) disconnect the mobile furnace from said second inert gas connection station; and k) discharge the reduced and cooled metal material from the mobile furnace.

In the following, the invention will be described in detail, with reference to exemplifying embodiments of the invention and to the enclosed drawings, wherein.

Figure 1:
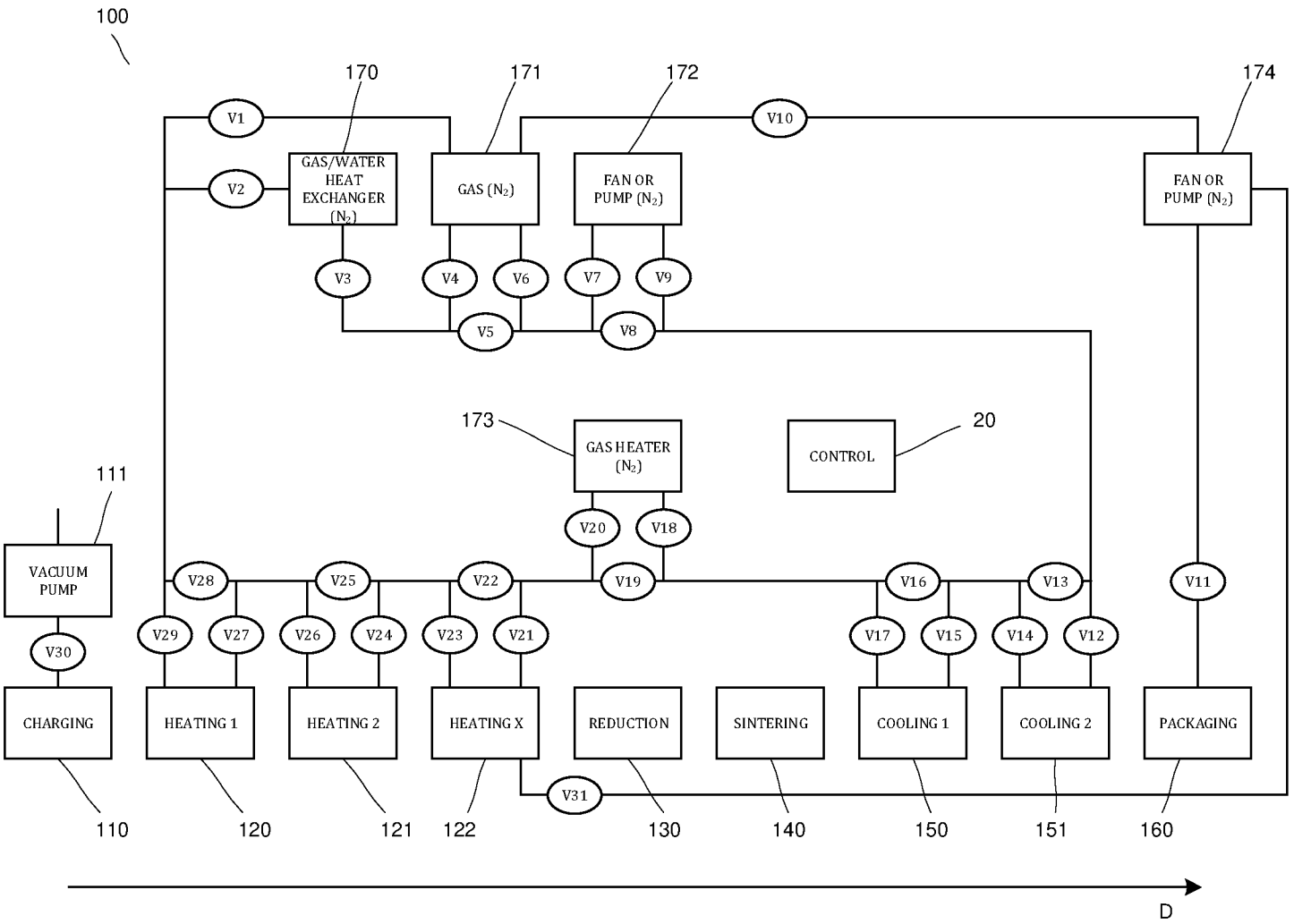
FIG. 1 is an overview of a system according to the present invention, arranged to perform a method according to the present invention, and specifically illustrating an inert gas flow for heating and cooling of a charged metal material in a mobile furnace.

FIGS. 1-7 share the same reference numerals for same or corresponding parts. It is noted that FIGS. 1-5 illustrate a system 100 according to the present invention from different perspectives, and that these Figures differ in details for reasons of clarity in each individual Figure.

The previously known solutions (referred to in the above-discussed earlier Swedish patent applications) are all focused on performing a complete process, including pre-heating, reduction and cooling in one and the same stationary furnace. Process efficiency was achieved using an overpressure inside the furnace in question; placement of a gas/gas heat exchanger in direct connection to the furnace, and in particular in direct connection to its furnace bottom; and using heating elements inside the heated furnace space. Furthermore, said previously known solutions achieved production flexibility by using several parallel such furnaces, and also by exploiting thermal efficiency-increasing mechanisms between such stationary furnaces.

Such solutions work well for smaller installations. However, for installations with higher throughputs this is not always the case.

For a larger installation, such as the present one, it is advantageous not to use a furnace space operating at atmospheric pressure or only a slight overpressure (such as at the most 50% overpressure, or even at the most 10% overpressure in relation to atmospheric pressure). Even though a larger overpressure results in an advantageous relationship between hydrogen and water vapour, and even though rapid reduction is then possible to achieve even with small gas recirculation, using a smaller pressure has proven possible and also represents a lower cost.

At a reduction temperature of about 550° C., an over temperature of about 100° C. is needed. The actual hydrogen requirement is provided according to the following (taking into account the relationship between hydrogen gas and water vapour at each temperature in question):

| Reduction temperature (° C.): | 550 | 600 | 650 |
|---|---|---|---|
| Hydrogen gas (%): | 80 | 75 | 72.5 |
| Water vapour (%): | 20 | 25 | 27.5 |

Using 600° C. as an average temperature value, and taking the specific example of hematite ($Fe_2O_3$), 421 $Nm^3$ hydrogen gas per tonne is theoretically required at equilibrium, and 25% water vapour is formed. This means that a total of 1684 $Nm^3$ hydrogen gas per tonne is required for full reduction. For the corresponding case of magnetite ($Fe_3O_4$), 387 $Nm^3$ hydrogen gas per tonne is used, implying that 1548 $Nm^3$ hydrogen gas is required to reduce one tonne of magnetite. Using metal material balls in a circular-cylindrical container, about 52% of the volume is solid material and about 48% is free space between the balls. Then we get:

| Charge weight (tonnes): | 1 | 2 | 5 |
|---|---|---|---|
| Container diameter (m): | 0.98 | 1.38 | 2.19 |
| Material bed height (m): | 0.5 | 0.5 | 0.5 |
| Space for gas ($Nm^3$): | 0.18 | 0.36 | 0.90 |

Using these values, it is possible to calculate a required flow given a desired reduction velocity and similar input values. By varying the gas flow and by measuring the amount of formed water, the temperature of the exiting gas and other parameters, it is possible to control the process for optimum efficiency.

In order to keep the system 100 free from air, the system 100 needs to be closed and there needs to be one or several fans or pumps to circulate the gas in the system 100. A vacuum pump can be used to pump any air out from the system 100 in connection to process initiation, and also for changing gasses during the process between processing steps.

According to said previous solutions, a gas/gas heat exchanger was placed in direction connection to an underside of the furnace, so as to be in close contact to the charged material. However, the present inventor has discovered that such a gas/gas heat exchanger can be arranged at a distance from the furnace space. This is advantageous in case there is a condensation of metals, such as lead or zink, in the gas/gas heat exchanger, requiring cleaning. Arranging a used gas/gas heat exchanger in a central location, as opposed to in direct connection to the furnace is also advantageous since it can easily be doubled, so that one such gas/gas heat exchanger can be stopped for cleaning while a parallel-installed gas/gas heat exchanger can operate for heat exchange. Using several parallel heat exchangers that can be put into operation individually also allows for using one, two or more such gas/gas heat exchangers at any given moment in time, increasing production capacity flexibility and lowering the risk of production stops. This is in particular the case if a set of such two or more parallel-installed gas/gas heat exchangers are interconnected to serve gas flows from several individual furnaces at the same time.

The present inventor also proposes to use a separate gas heater, arranged externally in relation to the furnace space. Namely, providing heating elements inside the furnace space, the furnace walls and the outside of a basket filled with the charged material will be heated before the charged material in itself if heated. Using a separate, externally arranged heating unit, heating gas before entering the furnace space, this externally heated gas can be supplied to the furnace space from below of the charged material, upwards through the charged material. This way, the charged material is heated before the furnace walls and the basket walls. Also, this way of heating the charged material decreases the insulation thickness requirements for the furnace space, thereby lowering furnace weight and cost.

Correspondingly, during cooling of the charged material, the cooling gas can advantageously be introduced into the furnace space from below, through the charged material.

As is the case for the above-discussed gas/gas heat exchangers, any used gas heaters and/or coolers may be arranged externally in relation to the furnace space, such as centrally arranged, and may comprise two, three or more parallel-arranged heaters/coolers operating one or several at a time, in a respective parallel flow, offering flexibility and resilience.

By providing furnaces, heat exchangers and other equipment as replaceable components that can be used one or several in parallel, the system becomes much more flexible as a whole, in terms of total throughput and capacity; and maintenance.

Just as said previous solutions, the present invention furthermore uses the basic concept of using one and the same furnace space for both heating, reduction and cooling, simplifying the process and decreasing requirements for transportation of the material between and through furnace spaces.

However, instead of connecting different gas flows to a stationary furnace, the present invention proposes to physically move the furnace to different stationary stations for provision of different gas flows to accomplish heating, reduction, cooling and any other processing steps that may be required. Said stations may then be interconnected for handling thermal transfer between different parts of the system, overall achieving a very flexible yet efficient system for performing a direct reduction of metal material.

Figure 7:
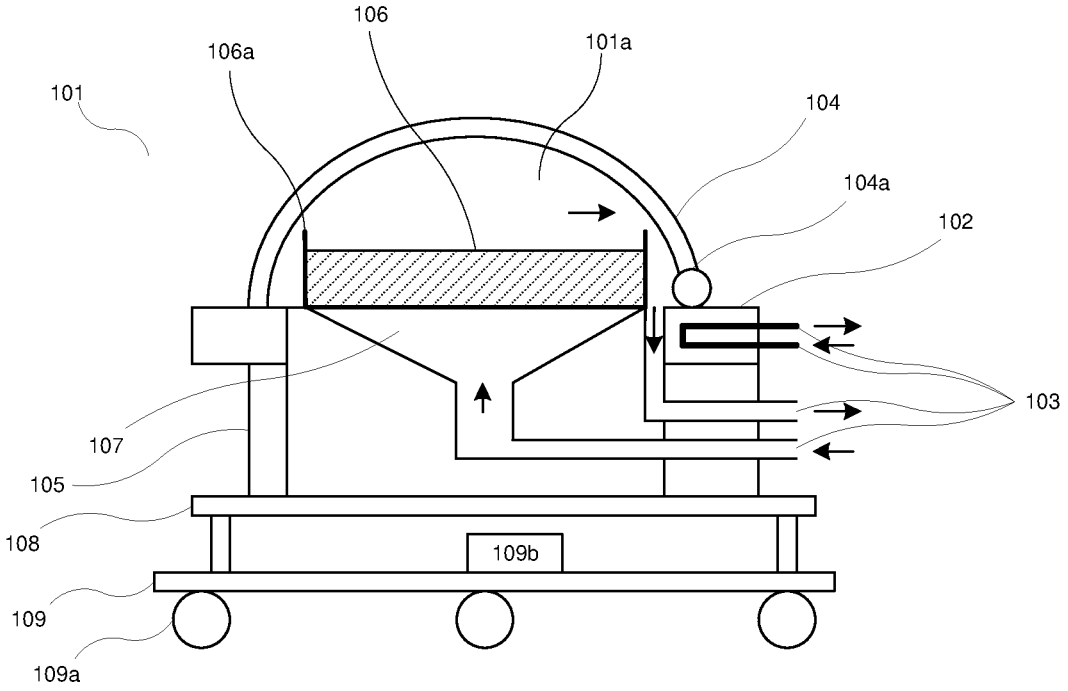
FIG. 7 is a simplified view of a mobile furnace.

As is illustrated in FIG. 7, such a mobile furnace 101 according to the present invention may comprise a main furnace body in turn comprising a lower part 105 and an upper part 104. The upper part 104 may be openable, using a hinge 104*a* or similar mechanism, to expose an interior 101*a* heated furnace space for charging and discharging of metal material 106 into and out from the furnace 101. The upper part 104 may be constructed from sheet metal, insulated using ceramic material. A connection part 102 between the upper 104 and the lower 105 may be arranged with connectors 103 for cooling water and various gas flows. The cooling water may be arranged to be circulated through the furnace 101 to cool the latter, such as to cool the connection between the upper 104 and lower 105 parts, the connection possibly being arranged as a peripheral connecting ring being water-cooled along the entire length of a peripherally running connection between said parts 104, 105.

The furnace 101 may further comprise a stand 108, providing a safe and stable table on which the furnace 101 can be placed. Each such stand 108 may be arranged for one single furnace 101, but may also be arranged to support two furnaces 101 that are then interconnected so that one such furnace uses waste heat from the other furnace in a way corresponding to what has been described in said above-referenced Swedish patent applications, using suitable a arranged gas/gas heat exchanger.

The stand 108 can be used in smaller installations, with stationary furnaces 101. Then, the stand 108 can be placed directly on the floor of a production facility. However, according to the present invention the stand 108 is arranged with movement means, such as wheels. In the preferred embodiment illustrated in FIG. 7, the stand 108 is provided on a movable platform 109 such as a trolley, in turn having wheels 109*a*. It is realized that the furnace 101, and in particular its lower part 105, may also be placed directly on the movable platform 109, and the stand 101 or the lower part 105 may be provided with wheels directly, without using the rest of the platform 109. The construction illustrated in FIG. 7 is preferred, since it provides the greatest overall flexibility.

Herein, a mobile furnace 101, including any stand 108 and/or movable platform 109, and in particular including any movement means, such as wheels 109*a*, is denoted a "mobile furnace".

The wheels 109*a* may be arranged to roll freely directly on a floor, or in a guided manner, such as on rails or similar. In either case, the present system may comprise a mobile furnace movement control device, such as a furnace control device 109*b* arranged on the individual mobile furnace 101 and arranged to control the propulsion and/or direction of the wheels 109*a*, and/or a central furnace control device 20 arranged to control rails or remote-control each mobile furnace 101 to control the movement of the mobile furnace 101 in question. It is realized that control devices 109*b*, 20 may cooperate in a per se conventional and suitable manner to achieve a desired movement patterns for the mobile furnaces 101 used in the system 100 in question. Control devices 109*b*, 20 may in particular be arranged to communicate using any suitable wired or wireless communication protocol. The furnace control device 109*b* may also comprise a battery, or an electric energy receiving device, for propulsion of the wheels 109*a* and powering of any control electronics onboard the mobile furnace 101. The control device 109*b* may also comprise a control mechanism for the mobile furnace 101 to be able to automatically dock connectors 103 to connection part 11 (see FIG. 6 and below). Such docking may be achieved in any suitable, per se known, way, such as using guiding rails, computer vision guidance, laser guidance, etc.

The control device 20 is arranged with logic and a communication interface to automatically perform all method steps described herein, unless otherwise stated, by mechanically controlling the various parts of the system 100 using per se conventional control mechanisms, such as using digital, electronic communication protocols arranged to impart control to physical control actors locally arranged on the various interacting system 100 components. The control device 20 may also comprise or be connected for communication with a suitable user interface for control and supervision of the system 100.

Figure 6:
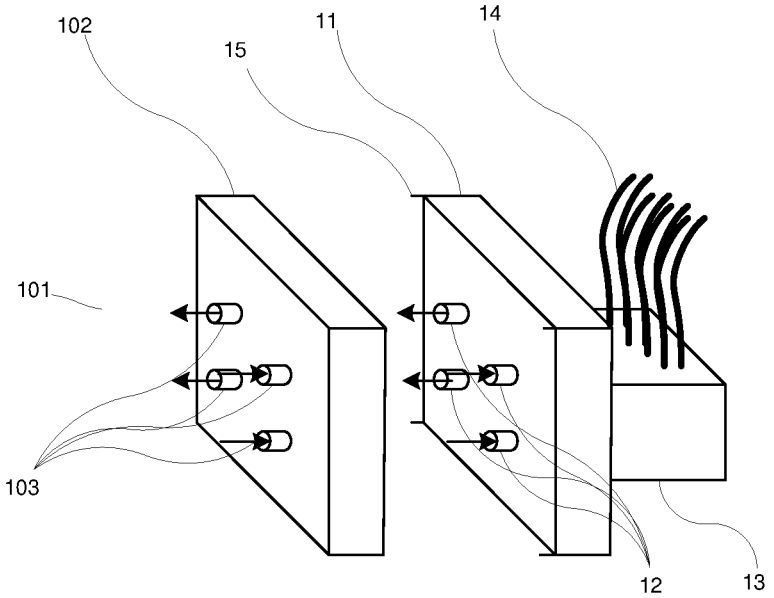
FIG. 6 is a simplified view of a connection between a mobile furnace and a connection station.

The connection part 102 is shown in more detail in FIG. 6, together with a corresponding connection part 11 of an exemplifying connecting station. Gas and cooling water is supplied to and from the connecting station to a centrally controlled valve system 13 via conduits 14 that are connected to the rest of the system 100. The valve system 13 is arranged to control the supply of desired fluids as a function of the presently conducted processing step of a mobile furnace 101 presently being connected to the connecting station in question.

Said fluids are provided from the connecting station to the mobile furnace 101 in question, and back, in a closed-loop circulation comprising the mobile furnace 101 in question, via interacting gas/water connectors 12, 103 as illustrated in FIG. 6.

Alignment means 15 may be used when docking the connection part 102 to the connection part 11.

The connection part 11 may also comprise any required measurement devices, for measuring pressure, temperature and/or any other desired parameter of incoming and/or outgoing gasses and/or cooling water, and to report such recorded measurement values to the control device 20 for use in control of the system 100 operation.

Electric heating elements are not arranged in the mobile furnace 101, but in a fixed and preferably central location, in connection to gas being supplied to the connection part 11 of each connecting station. Such heating elements may be electric molybdenum heating elements, and may be arranged in a closed space such as a box with the express purpose of providing heating to gas flowing through the closed space in question. As mentioned above, such heating devices may be arranged two or more separate ones in parallel, for increased flexibility and resilience.

For larger installations, such electric heating devices may be arranged only for connection stations for reduction, sintering and/or carburisation, whereas for more small-scale installations heaters may be provided for all connection stations. Namely, for larger-scale installations each connection station may be specialized for use for one particular purpose, while in smaller-scale installations one connection station may be used for different purposes depending on the current processing status of the system 100. The corresponding is true regarding the above-described gas/gas heat exchangers.

Gas provided to said connection stations is propelled using suitable fans or pumps, providing a suitable stream of the gas in question, in turn providing an optimised result in terms of processing time and flow/throughput of material to be reduced throughout the process line used. It is noted that the gas flow, possibly including one or several of relevant parameters such as gas volumetric flow, temperature and humidity, is preferably individually controlled, by said control device 20, to each individual connection station at all times, using said fan or pump and/or using other equipment described herein.

In a larger installation, there may be a separate gas circulation system for heating of charged material, and another separate gas circulation system for cooling of charged material. Such separate gas circulation systems may be circulation systems for an inert gas, and may comprise gas drying equipment to control humidity of the circulated gas, in particular cooling gas. Heat exchangers may be used to transfer heat from the cooling gas to the heating gas in such systems according to the invention. In other examples, such as the one shown in FIGS. 1-5, heating and cooling may share one and the same inert gas circuit.

The system 100 may also comprise a fan or pump for circulating the gas in the cooling/heating system, and arranged to control a flow velocity of gases from cooling of hot charged material to be cooled to heating of cool charged material to be heated. In a smaller installation, one and the same fan or pump can achieve several or all of such gas circulation tasks, while in a larger-scale installation there may be one or several dedicated fans and/or pumps for each of said gas circulation tasks. For instance, in a large-scale installation, heating and cooling of charged material may be performed using the same fan or pump and possibly also the same gas dryer, while gas circulation with respect to reduction, sintering and/or carburisation may be performed using a separate, dedicated fan and/or pump, potentially with a separate, dedicated gas dryer.

Figure 8:
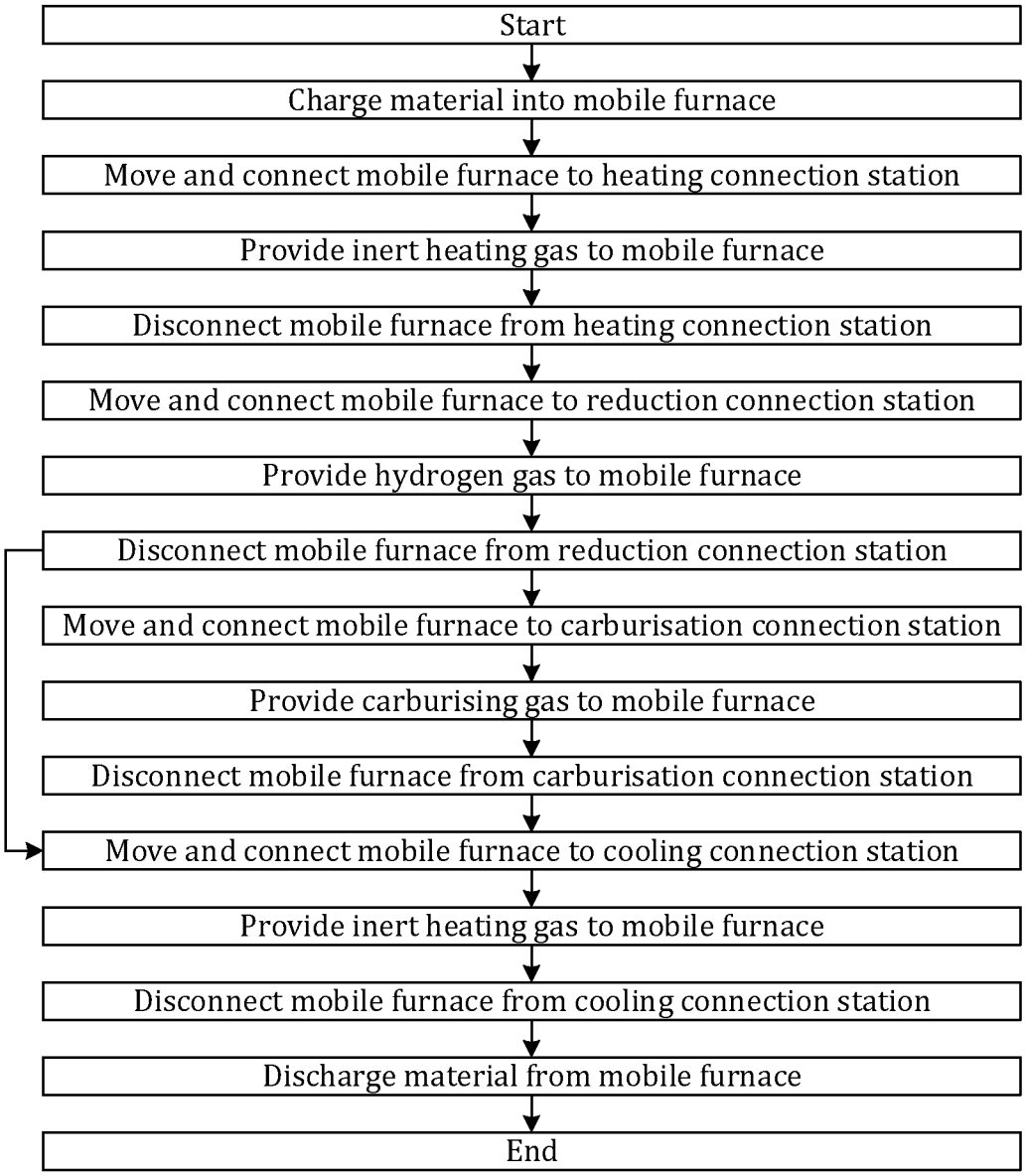
FIG. 8 is a flowchart illustrating a method according to the present invention.

FIG. 8 illustrates a method according to the present invention, performed using a system 100 illustrated in FIGS. 1-5.

The present method is generally a method for producing direct reduced metal material in a continuous process. As used herein, the term "continuous process" means a process which is not performed batch-wise. Hence, such a continuous process involves charging of new material at a process entry point and discharging of reduced material at an exit point, with one or more intermediary processing steps taking place between said entry point and said exit point, and where a next charging of material takes place before an immediately subsequently charged material is discharged. The charging and discharging itself may, of course, be performed in a discontinuous manner, but will form a continuous process over time as material is intermittently but constantly charged at one end and likewise discharged at the other end.

In the present invention, this process continuity is achieved using mobile furnaces 101 of the present type, moving between connection stations. Concretely, the metal material 106 to be reduced is charged into one of said mobile furnaces 101 at said point of entry, then moved in that same mobile furnace 101, without being discharged or reloaded, via a number of different processing connection stations, and finally to said exit point where it is discharged from the mobile furnace 101 in question. Hence, each such charged amount of metal material 106 can be viewed as a "batch", but since several such "batches" are processed at the same time along the production line, moving one after the next and concurrently, the total process becomes continuous in the above sense.

The present method comprises circulating hydrogen gas in a closed-loop first gas circuit by, using a first valve system, selectively circulate hydrogen gas via one or several of a set of several hydrogen gas connection stations 130, 140 (see FIG. 1).

Herein, that a gas is circulated "via" a connection station means that the gas in question is directed, in a lead conduit, to the connection station in question, and that it is then circulated further, in a separate conduit, away from the connection station and further in a closed-loop conduit circuit. As mentioned, the connection station in question is arranged with connectors 12 to provide the gas, from said lead conduit, to a mobile furnace 101 connected to the connection station in question, via conduits 103, so that the gas is circulated to the mobile furnace 101 and back again to the connection station in question and further away via said separate conduit. Normally, the gas will be circulated through a furnace space 101*a* of the connected furnace 101. In other words, the connection station and the connected furnace 101 form parts of said closed-loop circuit. It is further realised that cooling water is circulated in a corresponding manner, but not through the furnace space 101*a* (see FIG. 7, where the two lower conduits show gas connections and the two upper conduits, illustrated using thick lines, show cooling water connections). Preferably, each mobile furnace 101 comprises two gas connections 103 (one lead conduit and one return conduit), said two conduits being used for all gas circulation—inert gas, hydrogen gas, carburising gas, etc.—depending on the currently performed processing step for the mobile furnace in question.

The present method also comprises circulating an inert gas, such as nitrogen or argon, in a closed-loop second gas circuit by, using a second valve system, selectively circulate such inert gas via one or several of a set of several inert gas connection stations 120-122, 150-151, 160. The circulation of the inert gas is similar to the circulation of the hydrogen gas, but in an at least partly different closed-loop circulation.

At each connection station, the flow of the hydrogen gas, the inert gas, and any other circulated gas, and its access to a connected mobile furnace 101, is controlled by valve system 13 under the control of the control device 20. These gas circuits are preferably arranged so that inert gas is at no point mixed with hydrogen gas for circulation, apart from residual gases remaining in, for instance, a mobile furnace 101 after gas evacuation.

As will be described in details below, the system 100 also comprises heaters and heat exchangers for controlling the temperature of such gas circulated to each mobile furnace 101 at any particular point in time.

The method further comprises a number of processing steps, performed for each of a plurality of individual mobile furnaces 101 of the present type.

In general, each mobile furnace 101 is moved between said connection stations to be subjected to a number of different processing steps, comprising, in addition to charging and discharging, heating, reduction, sintering, carburisation and/or cooling. Each such processing steps can be served by one or several individual connection stations, each being arranged in series or in parallel to its peers in the same processing step.

Hence, in a first method step, the method starts.

In a subsequent step, an amount of metal material 106 to be reduced is charged into the mobile furnace 101, such as by opening the top part 104 and charging the metal material 106 into the furnace space 101*a* via a suitable automatic charging system, after which the top part 104 is again closed.

In a subsequent step, the mobile furnace 101 in question is moved to, and connected to, a first one of said inert gas connection stations 120-122, 150-151, 160. In FIG. 1, this first one is illustrated as any one of heating connection stations 120, 121, 122.

In a subsequent heating step, heated inert gas is provided to the mobile furnace 101, in the way described above, so that the metal material 106 in the mobile furnace 101 is heated by the heated inert gas circulating past the metal material 106 inside the mobile furnace 101, in the heated furnace space 101*a*.

Hence, inert gas is heated, preferably outside of the furnace space 101*a* and even outside of the mobile furnace 101, and circulated past the metal material 106 so that the metal material 106 is thereby heated.

In a subsequent step, the mobile furnace 101 is disconnected from said first inert gas connection station 120-122.

In a subsequent step, the mobile furnace 101 is physically moved to, and connected to, a first one of said hydrogen gas connection stations 130, 140. It is understood that the hydrogen station 130, 140 in question is physically a different connection station than the first inert gas connection station 120, 121, 122.

In a subsequent reduction step, the heated hydrogen gas is provided to the mobile furnace 101 in the above-described way, so that the metal material 106 is reduced by the heated hydrogen gas circulating past the metal material 106 inside the mobile furnace 101.

Hence, hydrogen gas is circulated past the heated metal material 106 so that the metal material 106 is thereby reduced.

In a subsequent step, the mobile furnace 101 is disconnected from said first hydrogen gas connection station 130, 140.

In a subsequent step, the mobile furnace 101 is physically moved to, and connected to, a second one of said inert gas connection stations 120-122, 150-151, 160. In FIG. 1, this second one is illustrated as any one of cooling connection stations 150, 151.

In a subsequent cooling step, cooled inert gas is provided to the mobile furnace 101 in the above-described way, so that the metal material 106 contained therein is cooled by the cooled inert gas circulating past the metal material 106 inside the mobile furnace 101. This cooling hence takes place in a way corresponding to the above-described heating step.

In a subsequent step, the mobile furnace 101 is disconnected from said second inert gas connection station 150-151.

In a subsequent step, the then reduced and cooled metal material 106 is discharged from the mobile furnace 101.

In a subsequent step, the method may end. However, it is realised that the present method will typically take place using a plurality of mobile furnaces 101, moving one after the other, along a chain of connection stations, as exemplified below, and may hence be continued for any amount of time in a continuous flow without interruption. As one mobile furnace 101 has discharged its material, it can again return to the charging station 110 to be replenished and start over.

In some embodiments, said hydrogen gas is circulated in said closed-loop first gas circuit at atmospheric pressure, or at a pressure of at the most 1.5 bars, or even at the most 1.1 bars.

Correspondingly in some embodiments, said inert gas is circulated in said closed-loop second gas circuit at atmospheric pressure, or at a pressure of at the most 1.5 bars, or even at the most 1.1 bars.

Figure 2:
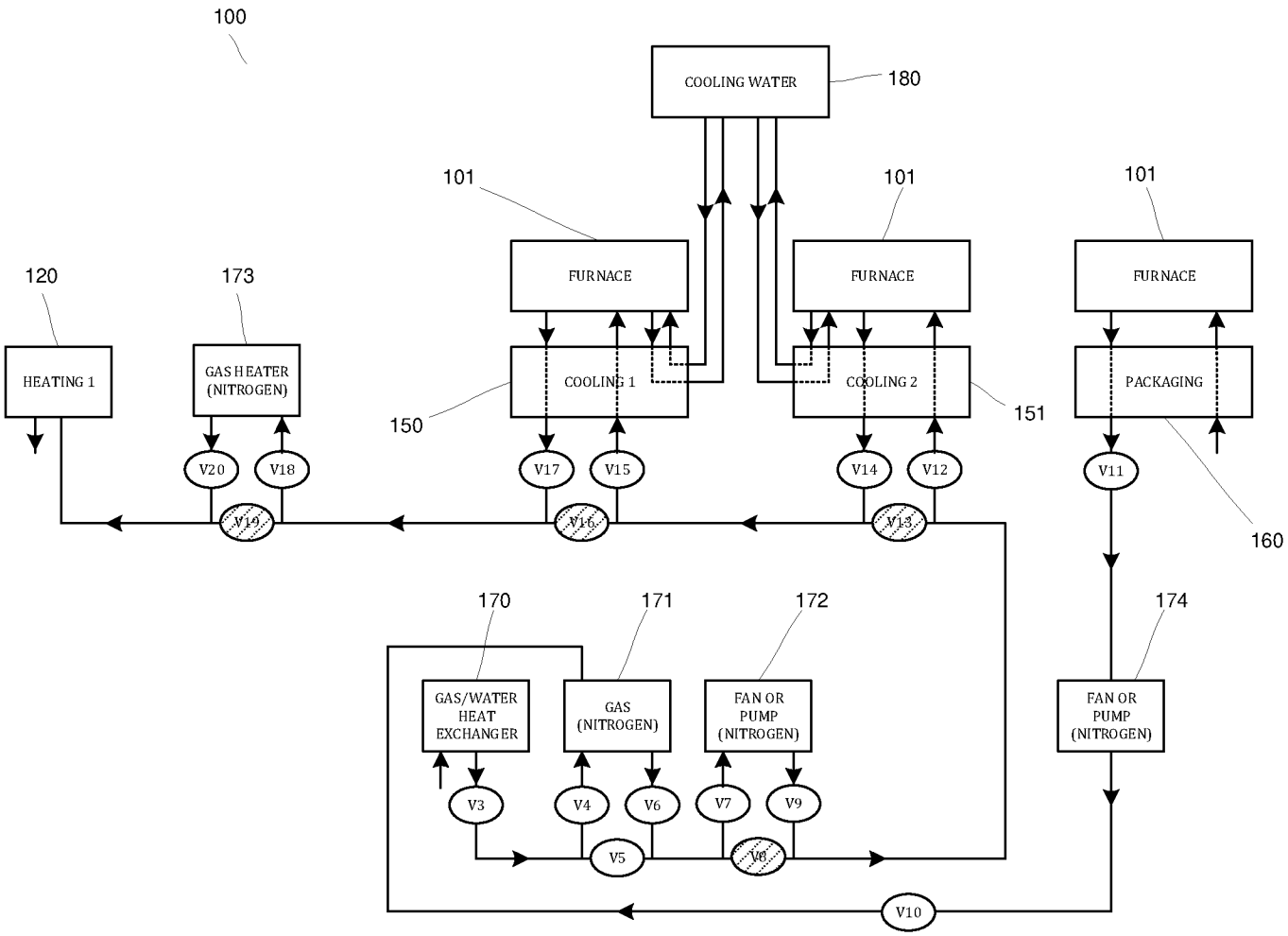
FIG. 2 is an overview corresponding to FIG. 1 but specifically illustrating a flow for cooling of a charged metal material.
Figure 3:
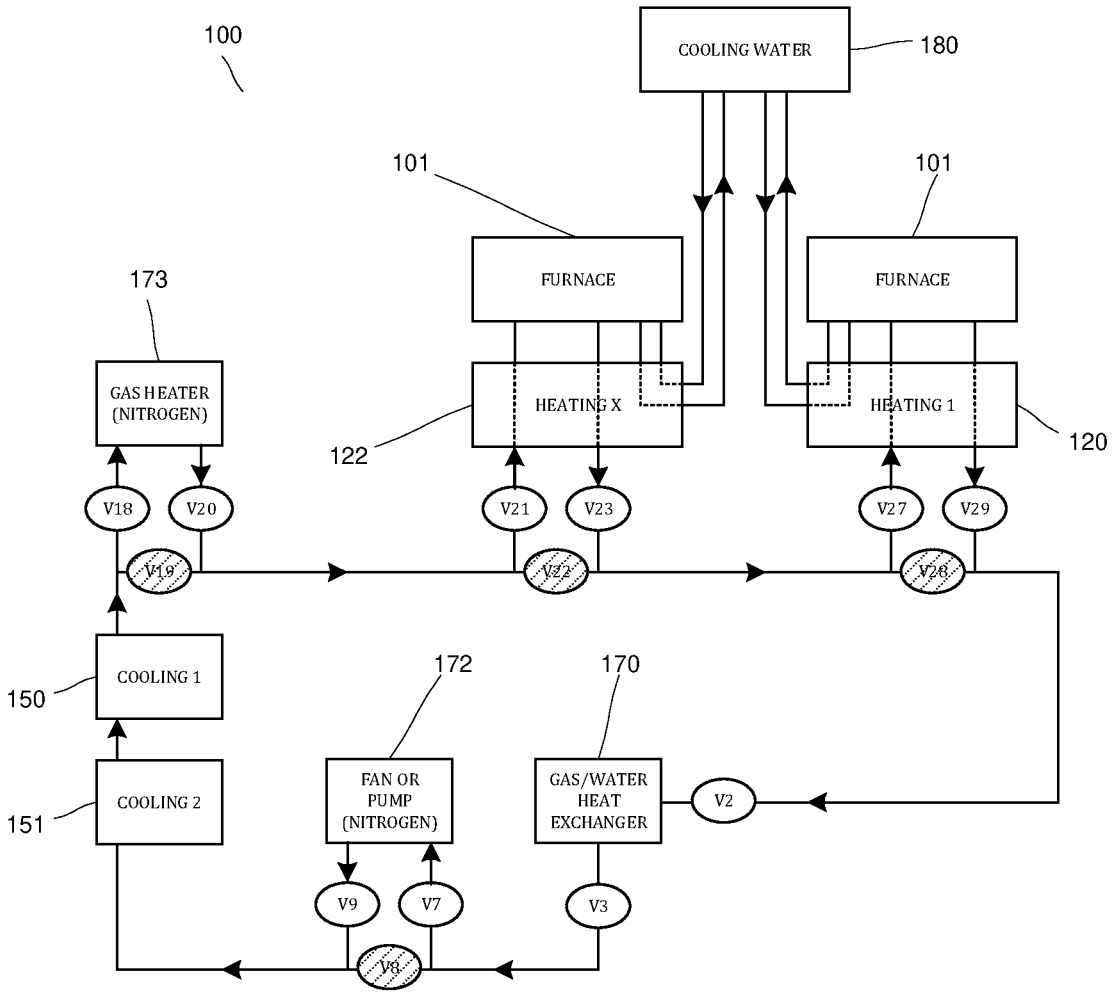
FIG. 3 is an overview corresponding to FIG. 1 but specifically illustrating a flow for heating of a charged metal material.

As mentioned above, the cooling inert gas, i.e. the inert gas used to cool the metal material 106 in the cooling step, may also be used to preheat the inert gas used to heat the metal material 106 in the heating step c. Such heat transfer may then be performed using a gas/gas heat exchanger. Alternatively, and as is illustrated in FIGS. 1-3, the inert gas used to cool the metal material may be used, after such cooling and possibly additional heating by gas heater 173, as the inert gas used to heat the metal material 106 that is to be reduced.

The method may comprise using several gas/gas heat exchangers in parallel, as discussed above, to exchange heat between said flows of inert gas, in parallel heat-transfer flows wherein several parallel flows of hot gas and/or several parallel flows of cool gas are heat exchanged to each other.

In addition to (or instead of) such heat exchange, the method may further comprise preheating the inert gas used to heat the metal material 106 in the heating step and/or preheating the hydrogen gas used in the reduction step using a gas heater 173, 191, such as an electric heater, provided upstream of the inert gas or hydrogen gas connection station 120-122,130,140 in question.

As mentioned above, the mobile furnace 101, in turn, is preferably passive in terms of heat provision, in the sense that it does not comprise an integrated source of thermal energy. Instead, all thermal energy provided to the metal material 106 during the processing, and in particular during the heating and/or reduction and/or any sintering and/or any carburisation, is provided externally via heated gas flowing into the furnace space 101*a*. It is, however, noted that exothermal reactions in the metal material 106 itself may provide thermal energy. What is important here is that no additional thermal energy is provided in the furnace space 101*a*, apart from any thermal input resulting from such possible exothermal reactions. Instead, by providing all thermal energy from external sources, the mobile furnace can be made simple, without any internal heaters, electric connections and so forth, making it robust and failproof while moving it between different connection stations as described herein.

As also discussed above, said inert gas and/or said hydrogen gas may be provided in the heating, reduction and/or cooling steps, to flow into the mobile furnace 101 and past the metal material 106 from below the metal material 106 upwards in the mobile furnace 101. The corresponding may also be true in any sintering and/or carburisation step.

Each mobile furnace 101 may comprise two furnace parts 104, 105 of the above-described types, arranged to engage with each other to form the closed furnace space 101*a*. Then, at least one of said two furnace parts 104, 105, or a connection between the two parts 104, 105 may be water-cooled using cooling water provided from a cooling water circulation system 180. The method may in this case further comprise circulating cooling water in said separate cooling water circuit. Moreover, said hydrogen 130, 140 connection stations and/or said inert gas 120-122, 150-151 connection stations may comprise connections for said cooling water so that the mobile furnace 101, when connecting to said connection station 120-122, 130, 140, 150-151 in question, is provided with such circulating cooling water. This provides an efficient way to cool all circulating mobile furnaces 101 in the system 100, and also provides an way to make good use of the heat cooled off from the mobile furnaces 101 and carried away from the mobile furnaces 101 by said cooling water. For instance, the heated cooling water may be used for providing heated water in a district heating system, or similar.

A circulation velocity (or volume flow per time unit) of gas circulating in said first and/or second gas circuits may be controlled, using a fan or pump (172,194) the speed of which can be controlled by the control device 20, so that a heating power, reduction velocity, sintering rate, carburisation rate and/or cooling power of the metal material 106 is controlled as a result to be at a desired respective set value, which may of course change over time. Measurement values from each mobile furnace 101 regarding temperatures, as well as measurements regarding temperatures, moisture-contents, chemical compositions, water contents, etc. from other parts of the system 100 may also be used as input data to the control device 20 for basing the control of the system's 100 operation on.

Figure 5:
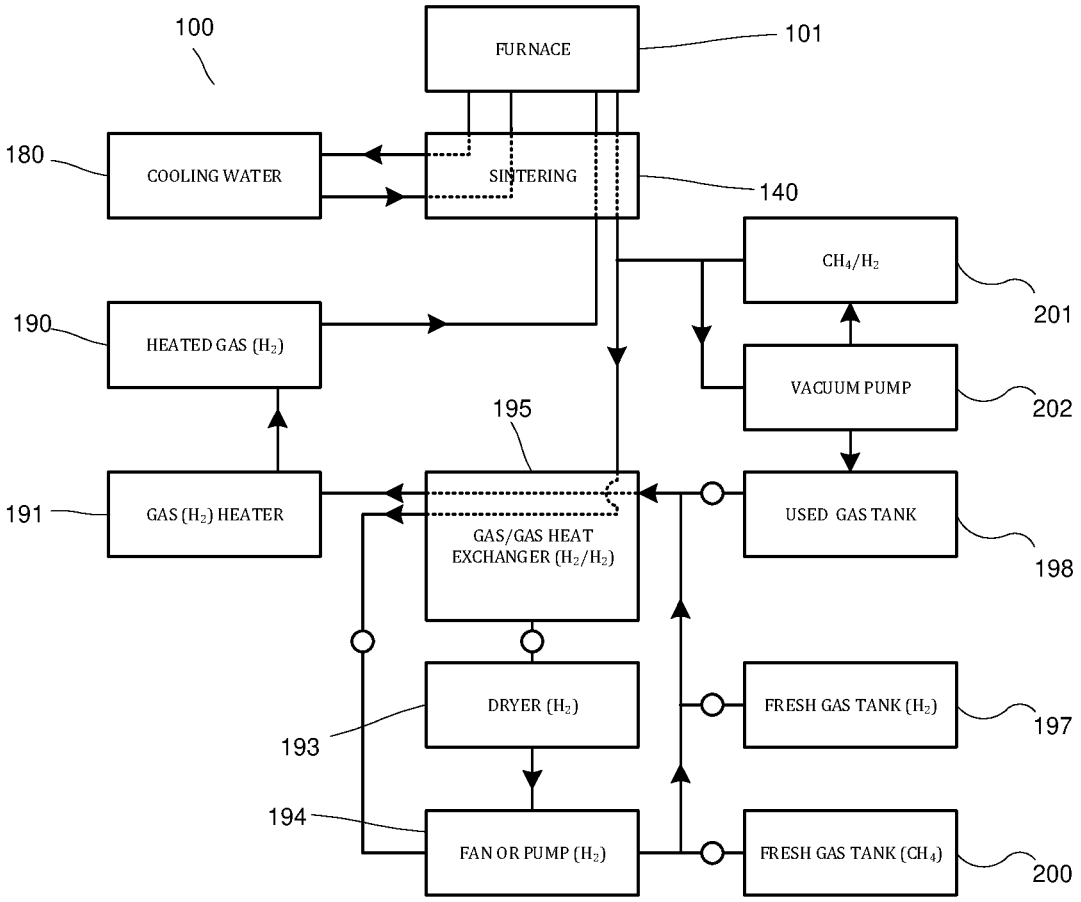
FIG. 5 is an overview corresponding to FIG. 1 but specifically illustrating a flow of hydrogen gas for sintering of a charged metal material.

Further in some embodiments, the reduction step may further comprise continuing the provision of the heated hydrogen gas to further sinter the metal material 106 after the metal material 106 has been reduced. In FIGS. 1 and 5, this is illustrated by a separate sintering connection station 140, to which gas is fed, in the general way discussed above, to the connected mobile furnace 101.

Moreover, in some embodiments the metal material may be carburised using a carbon-containing gas such as $CH_4$. The carbon-containing gas may be provided via a dedicated connection station (not shown), via a reduction connection station 130 and/or a sintering connection station 140. In the example shown in FIGS. 1 and 5, the carburisation takes place by the sintering station 140 being arranged to provide $CH_4$ gas via valve system 13.

Hence, the method may further comprise circulating such a carbon-containing gas in a closed-loop third gas circuit by, using a third valve system, selectively circulate said carbon-containing gas via one or several of said set of several hydrogen gas connection stations 130, 140. Specifically, the reduction step (or a subsequent sintering step or a dedicated carburisation step) may further comprise providing said carbon-containing gas to the mobile furnace 101 so that the metal material 106 is carburised by the carbon-containing gas circulating past the metal material 106 inside the mobile furnace 101.

The third closed-loop gas circuit may be partly or entirely the same as the second closed-loop gas circuit, or a separated gas circuit.

In the case in which the carburisation does not take place at a reduction connection station 130, the system 100 may comprise a set of one or several carbon-containing gas connection stations. Then, the method may further comprise the following steps, performed after the mobile furnace is disconnected from the reduction connection station 130 but before the cooling step:

First, the mobile furnace 101 may be moved to, and connected to, a first one of said carbon-containing gas connection stations.

Second, the carbon-containing gas may be provided to the mobile furnace 101 so that the metal material 106 is carburised by the carbon-containing gas circulating past the metal material 106 inside the mobile furnace 101.

Third, the mobile furnace 101 may be disconnected from said first carbon-containing gas connection station.

FIG. 1 shows a sintering station 140, used to sinter the metal material 106 at a higher temperature than the reduction step uses. The carbon-containing gas may then be provided via one or several of such sintering connection station 140, such as a controlled mixture of hydrogen gas with carbon-containing gas.

It is realized that, in case there are more than one heating stations 120-122; more than one reduction stations 130; more than one sintering stations 140; more than one carburisation stations; and/or more than one cooling stations 150-151, the method may comprise disconnecting the mobile furnace 101 from a first one of the type of connection station in question and moving the mobile furnace 101 to, and connecting it to, a second one of the type of connection station in question, and so forth, so that the mobile furnace 101 is connected for processing to two or several connection stations of the same type in series over time. This will be exemplified below. There may also, in addition to or instead of this, be several parallel flows of mobile furnaces 101 using different connection stations of the same type, depending on the size of the installation and a desired total throughput.

As described above, the present method uses separate connection stations for processing metal material 106 in each mobile furnace 101 in a number of consecutive processing steps, including all or some of heating, reduction, sintering, carburisation and cooling. As mentioned, any carburisation may take place in a separate connection station or as a part of, for instance, a sintering connection station 140.

Of these steps, the reduction step is typically the least time-consuming, in particular in case the material 106 is heated all the way up to a suitable reduction temperature during the heating step. Normally, it is the heating and cooling step that takes the longest time. This is important when designing a larger-scale and highly automated installation, in which many mobile furnaces 101 are used.

Typically, in a larger-scale installation, at least 10 mobile furnaces 101 are used at the same time, such as at least 20 mobile furnaces at the same time. The mobile furnaces 101 themselves can, however, also be used in smaller installations, due to the modular design offered by the mobile furnaces 101. Scaling up or down merely implies adding or removing connection stations, while using a suitable number of mobile furnaces 101 of the same type.

Preferably, each mobile furnace 101 is designed to hold at least 1000 kg of metal material. Also, each mobile furnace 101 is designed to hold at the most 10000 kg of metal material.

In general, the present system 100 may comprise the following parts:

- A crushing device, arranged to produce a suitable metal-containing powder material for manufacturing of balls of such material;
- A ball manufacturing device, arranged to produce metal-containing material balls, such as having a diameter of 1-5 cm, for direct reduction using the present method;
- A charging device, arranged to charge the produced balls (or similar or other metal material locally produced or received from a remote production facility) into said mobile furnace 101;
- A heating device, comprising one or, preferably, several heating connection stations 120-122, for heating the charged metal material to a process temperature of, for instance, 550-600° C., preferably using preheated gases received from a downstream cooling step;
- A reduction device, comprising one or, preferably, several reduction connection stations 130;
- A sintering/carburisation step, comprising one or, preferably, several sintering/carburisation stations 140;

A cooling step, comprising one or, preferably, several cooling connection stations 150-151, arranged to cool the charged metal material 106, such as to a temperature of maximally 100° C., such as maximally 50° C.; and/or A discharging/packaging step 160, in which the reduced/sintered/carburised material 106 is discharged from the mobile furnace 106 and suitably packed for further processing and/or transport.

Preferably, charging and discharging takes place automatically, such as using a suitable robot arm.

In a smaller-scale installation, heating, reduction, sintering and/or cooling can take place using only one connection station per such processing step, while in a larger installations one or several of said processing steps can take place using two or more connection stations, arranged in parallel and/or in series.

In a smaller-scale installation, transport of the mobile furnaces between said connection stations can take place via overhead cranes or trucks, why the mobile furnaces in this case need not be arranged with wheels 109*a*, and in some cases not even with trolleys 109. In a larger-scale installation on the other hand, transport may instead take place using rails or free-moving computer-controlled trolleys 109 such as described above. It is realized that the above-described construction with stands 108 and platforms 109 provides a convenient way of scaling up or down between such smaller-scale and larger-scale production units, using the same component parts but only varying the number of mobile furnaces 101 and connection stations, and, as required, transport mechanism.

Apart from the desired total throughput, the number of connection stations of each of said different types is primarily determined by the processing time (the total time spent) of a mobile furnace 101 in any one processing step, in combination with a number of parallel-operating connection stations for the processing step in question. Since the different processing steps will typically be associated with different processing times, the processing step with relatively short processing times will decide how the preceding and proceeding processing steps are to be arranged. For instance, if the processing time of a previous processing step is longer, a subsequent processing step must be arranged with more parallel connection stations than the previous one, in order to achieve a smooth and even flow of mobile furnaces 101 between the processing steps. The corresponding applies in case of a slower (longer in terms of time) proceeding processing step in comparison to a preceding processing step.

For instance, normally the reduction processing step is a relatively fast step (requiring the shortest processing time). The reduction step will typically be followed by the sintering/carburisation step, the latter also involving a heating of the material 106. If, for instance, the time required for the sintering/carburisation to be accomplished is double the time required for the reduction, the number of sintering/carburisation connection stations 140 for receiving mobile furnaces 101 from the reduction connection stations 130 must be twice the number of said reduction connection stations 130. Correspondingly, at the interface between the heating connection station(s) 120-122 and the reduction connection station(s) 130, the time required for reduction will typically be shorter than that for heating the metal material 106 to reduction temperature, meaning that more heating connection stations 120-122 than reduction connection stations 130 will typically be required.

As mentioned, another difference between the different processing steps is that the heating and cooling steps use an inert gas, such as nitrogen gas, for carrying thermal energy to or from the mobile furnaces 101, while reduction and sintering, for instance, use hydrogen gas. Furthermore, any carburisation step uses a carbon-containing gas such as a hydrocarbon, for instance $CH_4$, that may be used together with the hydrogen gas in the same closed-loop circuit.

FIG. 1 illustrates, schematically, an example of a larger-scale installation system 100 according to the present invention.

As is shown in this FIG. 1, the heating and cooling processing parts are interconnected and together form a closed gas system, in which nitrogen gas (or any other inert gas) is pumped or circulated so as to transfer the thermal energy from the metal material 106 at the cooling end to heat the incoming, cool metal material 106 arriving from the charging, before being passed on to reduction. As described above, the transport of the metal material 106 takes place by the metal material 106 being carried in mobile furnaces 101 of the present type, in turn being moved between different connection stations for being provided with different gas flows in order, and for suitable/predetermined time periods.

As also mentioned above, the time required for heating and cooling of the metal material 106 will normally be longer than for reduction and sintering/carburisation of the metal material 106, why there will normally at any one given point in time be more connection stations and mobile furnaces operating in these heating/cooling processing steps than for reduction and sintering/carburisation.

Consequently, the method may comprise using more inert gas connection stations 120-122, 150-151, running in parallel and/or in series, than a number of hydrogen gas connection stations 130, 140 being used in parallel and/or in series.

In this example embodiment, reduction and sintering is performed in a way that will be described below. However, both the inert gas circulation system and the hydrogen/carbon-containing gas circulation system are respective closed systems, arranged to emit substantially no such gas into the environment or across to each other.

Hence, all processing steps according to the present invention may preferably take place in a closed system 100 in which the movable furnaces 101 are moved between the different steps in the system 100. Within the frame of each processing step, the movable furnace 101 in question will be connected to a respective connection station at a time within that processing step.

The set of several mobile furnaces 101 carrying the metal material through the various processing steps form a part of this same closed system 100, whereby all processes take place in the closed system 100 in the mobile furnace 101 in question moving between and connecting to, connection stations in the various processing steps. To this end, the furnace 101 opening mechanism 104*a* may preferably be arranged so that the closed furnace space 101*a* is gas-tight and arranged to withstand a certain overpressure (and underpressure, correspondingly), of at least 1.5 bars, without any gas leakage. For instance, the upper part 104 can be held closed in relation to the lower part 107 using a hydraulic or screw-type pressing mechanism which may be automatically activated in connection to charging at station 110.

All, or at least several, of said mobile furnaces 101 may be identical, or at least have identical interfaces to the connection part 11, whereas each connection station is arranged to provide a desired gas with desired properties to the mobile furnace 101 at each individual connection station, preferably together with a parallel flow of cooling water as described above. This way, the mobile furnaces 101 may be replaceable, and the system 100 may be expanded or scaled down by simply adding or removing mobile furnaces 101.

From a thermal point of view, most heat transfer occurs to the charged metal material 106 in connection to heating before reduction (taking place at 550-580° C.) and during any sintering/carburisation (taking place at 900-1000° C.). Thereafter, thermal energy may be transferred from the charged material 106, during cooling, down to about 20-50° C. for discharging and packaging.

To match the shortest processing time (typically the reduction time), both the heating and cooling step may each advantageously be arranged comprising one or several series-connected series of connection stations 120-122; 150-151, where the processing time in relation to each such connection station 120-122; 150-151 is at the most, or exactly or at least approximately, the same as the processing time for the shortest-time processing step (in this case, at the single reduction connection station 130). Hence, if the reduction step takes 30 minutes, another mobile furnace 101 will arrive at a first cooling connection station 150 each 30 minutes, holding a temperature of 900° C. or similar.

Since the first cooling connection station 150 after the sintering/carburisation connection station 140 needs to be available (not currently being connected to a served mobile furnace 101) as the new mobile furnace 101 arrives from station 140, the preceding mobile furnaces 101 in order must already have moved along to the next connection station by that time. Hence, the mobile furnaces 101 move along a series of cooling connection stations 150-151 in order, until the temperature of the metal material 106 in the mobile furnace at the end of this series reaches a desirable temperature for discharging, such as 50° C. Hence, the series of cooling connection stations 150-151 may comprise a number of such stations 150-151 (larger than the two such stations shown in FIG. 1), such that the metal material 106 reaches about 50° C. at the end of the series when spending about 30 minutes connected to each of the connection stations 150-151 in series. For fine-tuning, the control device 20 can control the pressure or cooling gas flow velocity circulated to each of said cooling connection stations 150-151 individually, at each point in time, such as by controlling valves V12, V14, V15, V17, or by controlling the total flow through all cooling connection stations 150-151 on a higher level, such as by controlling fan or pump 172.

The corresponding is also true regarding the heating connection stations 120-122, operating in series.

In addition, one or several such series of heating/cooling connection stations 120-122; 150-151 may also be arranged in two or more parallel flows, each serving its own respective flow of mobile furnaces 101.

As a mobile furnace 101 is disconnected from a particular connection station, the gas connection to the mobile furnace 101 is broken and a valve in the valve system 13 switches off the gas supply to the connectors 12. As the mobile furnace 101 connects to a particular connection station, the gas connection to the mobile furnace 101 is opened, and a valve in the valve system 13 turns on the gas supply to the connectors 12.

At the packaging station 160, the temperature of the reduced material 106 is preferably below 50° C., in order to avoid reoxidation of the reduced material. In the charging step, the charging at the charging station 110 may take place by charging the material 106 in a basket 106*a* (FIG. 7), the basket 106*a* being filled with metal material 106 to be reduced into the furnace space 101*a* of the mobile furnace 101. Then, the discharging step may comprise discharging the basket 106*a* from the furnace space 101*a*. Hence, the metal material 106 may be transported around the system 100 in a number of such baskets 106*a*, each basket 106*a* in turn being charged into and out from mobile furnaces 101.

In order to empty the furnace space 101*a* from inert cooling gas, before opening the furnace space 101*a* at the packaging station 160, the mobile furnace 101 is connected to fan or pump 174 via valves V10 and V11, and the inert gas is led to an inert gas storage 171. Thereafter, valves V10 and V11 are closed, the fan or pump 174 is switched off, and atmospheric air is allowed into the opening furnace space 101*a*. The upper part 104 is lifted, and the basket 106*a* containing reduced, cooled metal material 106 is lifted out from the mobile furnace 101. The basket 106*a* is emptied, and may again be put in its place inside the mobile furnace 101. Thereafter, the mobile furnace 101 may be moved back to the charging station 110 to again being charged with metal material 106 to be reduced. Alternatively, the baskets 106*a* may be moved around in a separate flow, so that the mobile furnace 101 leaves the discharging station 160 empty and is provided with a new, filled basket 106*a* at the charging station 110 for another run along the processing line.

The cooling- and heating loop forms a closed unit, that starts at the charging of gas from the gas storage 171, the gas entering via valve V6. Valve V5 being closed, the gas continues on via valve V7 (valve V8 being closed) and fan or pump 172, valve V9 and on to the last cooling connection station 151. In case no mobile furnace 101 is currently connected to this connection station 151, valves V12 and V14 are closed, and valve V13 is open to allow the gas to continue to the next upstream cooling station 150, bypassing the non-connected station 151. If, on the other hand, the last cooling station 151 is connected to a mobile furnace 101, valve V13 is closed and valves V12 and V14 are open so that the inert cooling gas enters via V12 into the cooling station 151 and further into the connected mobile furnace 101, via the material 106 in said mobile furnace 101, to cool the material 106, and again on, via valve V14, to the next upstream cooling connection station 150, via valve V15 and into the mobile furnace 101 currently being connected to that connection station 150. In this situation, valve V16 is closed and the cooling gas, having already been somewhat warmed by the material 106 at connection station 151 is used to cool the material 106 in the mobile furnace 101 connected to connection station 150, the latter material 106 being warmer than the already cooled material at connection station 151. It is realized that there may be more than two cooling connection stations 150-151 in such a series serving a flow of mobile furnaces 101, the cooling gas flowing in a counter-direction as compared to a general moving direction D of the mobile furnaces 101.

The cooling gas flow is illustrated, using flow arrows of cooling gas and cooling water from a cooling water circulation system 180, in FIG. 2. Switched-off valves are shown with dashed lines.

At the upstream-most arranged cooling connection station 150, the now warmed cooling gas exits via valve V17 at a temperature that may be about 800-900° C.

This hot inert gas may then be used to heat the to-be-reduced metal material 106 in the heating connection stations 120-122 before this material 106 is brought to the reduction station 130.

This heating using the inert heating gas (that arrives from the cooling connection stations 150-151 where the very same inert gas served as cooling gas) may take place, similarly to for the cooling connection stations 150-151, in a counter-flow manner with respect to a general movement direction D of the moving mobile furnaces 101 along the heating stations 120-122 forming the processing line, and is illustrated using arrows in FIG. 3, being similar to FIG. 2 for the cooling gas flow. Hence, in FIG. 1, the inert gas flows to the left while the mobile furnaces 101 move to the right along the series of connection stations 120-122; 150-151.

Hence, the inert heating gas flows in, through valve V21, into the most downstream-arranged mobile furnace 101, at heating connection station 122. Valve V22 being closed, the heating gas continues out via valves V23 and V24 (valve V25 being closed), to the next upstream mobile furnace 101 at connection station 121, via valves V26 and V27 (valve V28 being closed) to the upstream-most mobile furnace 101 at connection station 120, and then out via valve V29.

In general, in some cases several of the inert gas connection stations 120-122, 150-151 may be used at the same time to heat and/or cool several mobile furnaces 101 in parallel. Them, the present method may comprise circulating the heated inert gas and/or cooled inert gas in a direction opposite to a general process flow D of the mobile furnaces 101, past said several mobile furnaces 101 in series, and to move said mobile furnaces 101 in said process flow D between said inert gas connection stations 120-122, 150-151 one by one, by disconnecting a mobile furnace 101 from one of said inert gas connection stations 120-122, 150-151, moving the mobile furnace 101 in question and connecting it to a next one of said inert gas connection stations 120-122, 150-151 in order.

Prior to reduction, the metal material 106 may be heated to at least 350° C., such as at least to 400° C., such as to at least 500° C., and/or to at the most 650° C., such as to the most 500° C. Since the heating gas is inert, the charged material 106 is not chemically affected by this heating. However, contained metals having relatively low smelting- or evaporation points may change aggregation states at too high temperatures. Therefore, the metal material 106 is preferably not heated to a temperature at which contained metals in the metal material 106 start to melt or evaporate before reduction, so that any evaporation of such contained metals can instead take place in the reduction station 130, having means to condense such evaporated metals in the form of gas/gas heat exchanger 195.

In general, the reduction step may comprise heating the metal material 106 past a melting and/or evaporation temperature for a contaminant present in the metal material 106, using the heated hydrogen gas as heat source for said heating.

In case the inert heating gas needs additional heating before entering the downstream-most heating connection station 122, valve V19 is closed and valves V18, V20 are opened, so that the inert gas passes by gas heater 173 between station 150 and station 122. As mentioned, this may, for instance, depend on a desired maximum heating temperature for the metal material 106 to be reduced based on chemical composition of this material 106. For instance, in case the metal material 106 contains no easily smelted/evaporated metals, a heating temperature of about 700° C. may be desired to be provided to station 122, and the gas heater 173 may then be selectively engaged to achieve this temperature of the inert heating gas. In case no additional heating is required, valve V19 is opened and valves V18, V20 are closed, so that the gas heater 173 is disengaged.

In case the downstream-most heating connection station 122 is not occupied by a connected mobile furnace 101 at the moment, valve V22 may be opened and valves V21, V23 closed, so that the inert heating gas is directly fed to the next upstream-arranged connection station 121, bypassing station 122.

As the desired temperature in the metal material 106 in the mobile furnace 101 connected to the station 122 is reached, valve V22 is opened and valves V21, V23 are closed, and the inert gas is directly fed to the next upstream-arranged station 121. Since the mobile furnace 101 at the last heating station 122 at this point is filled with inert gas, valve V31 is opened, being in contact with fan or pump 174, in turn being in contact with gas storage 171 via valve V10 (opened). This way, the inert gas is evacuated from the mobile furnace 101 at station 122 back to the gas storage 171. In case the evacuated inert gas is too high, a cooler may be used to lower its temperature before storage. When the inert gas has been evacuated from the mobile furnace 101, valves V31, V10, V11 are closed, the fan or pump 174 is switched off and the mobile furnace 101 is ready to be moved to the reduction step 130.

The somewhat cooled inert gas continues, as described, upstream towards and to the first heating connection station 120 (being the first station 120 after the charging station 110), heating the metal material 106 in each consecutive connected mobile furnace on its way.

The upstream-most station 120 may be empty, in which case valves V27, V29 are closed and valves V28 is opened, to bypass station 120.

The inert gas may be taken, via valve V2, to gas/water heat exchanger 170, where the inert gas is cooled to about 20° C. or any other suitable temperature achieving sufficient drying of the inert gas. It may also be possible to use a gas dryer (not shown) in connection to the gas/water heat exchanger 170. The thus heated water may, again, be used for instance in a district heating system.

In case the inert heating gas drops in temperature along its path along stations 120-122 so that it is no longer useful for heating the metal material 106 past which it circulates, valves V2, V24-V29, or correspondingly depending on where the flow of inert gas is to be interrupted to stations 120-122, can be operated so that the heating gas is taken directly to the gas/water heat exchanger 170 instead of continuing to be flowed past the metal material 106. The temperature of the heating gas leaving the upstream-most heated mobile furnace 101 is preferably at least 100° C., so that it can bring any contained water vapour with it to the gas/water heat exchanger 170 for deposit of such water in liquid form.

The inert gas is then brought, via fan or pump 172, back to the cooling step so as to form the above-discussed second closed circulation loop. Gas storage 171 is used to control the inert gas pressure in this loop to a selected even pressure between 1.0 and 1.5 bars, such as between 1.0 and 1.1 bars.

After valve V29, the inert gas passes either valve V1 or valve V2, depending on what one of these valves V1, V2 is open. In case the gas is already dry, it can pass via valve V1 (valve V2 being closed) back to the gas storage 171, and on via fan or pump 172. In case the gas is moist, valve V1 can be closed and valve V2 open, so that the gas passes the gas/water heat exchanger 170 for drying before, via valves V3, V5, going back to fan or pump 172. As long as inert gas circulation is ongoing, valve V8 is closed and valves V7, V9 are opened.

At the charging station 110, the basket 106*a* is filled with metal material to be reduced, and the basket 106*a* is placed in the mobile furnace 101. After the furnace space 101*a* has been sealed, contained air is evacuated using vacuum pump 111 and via valve V30, to achieve a predetermined underpressure in the furnace space 101*a*. Then, the mobile furnace 101 is moved from the charging step 110 to the first heating connection station 120 to begin its voyage between the connection stations as described above, in general direction denoted D in FIG. 1. At station 120, the mobile furnace 101 is connected to the inert gas circuit, and from that point it forms part of the inert gas closed circuit.

As mentioned above, the fastest accomplished processing step in the present method is usually the reduction, perhaps followed by sintering, if used. The slowest accomplished processing step is likely cooling, followed by heating. Therefore, for each reduction connection station 150 there is preferably several mobile furnaces 101 having newly charged baskets 106*a* awaiting heating.

Figure 4:
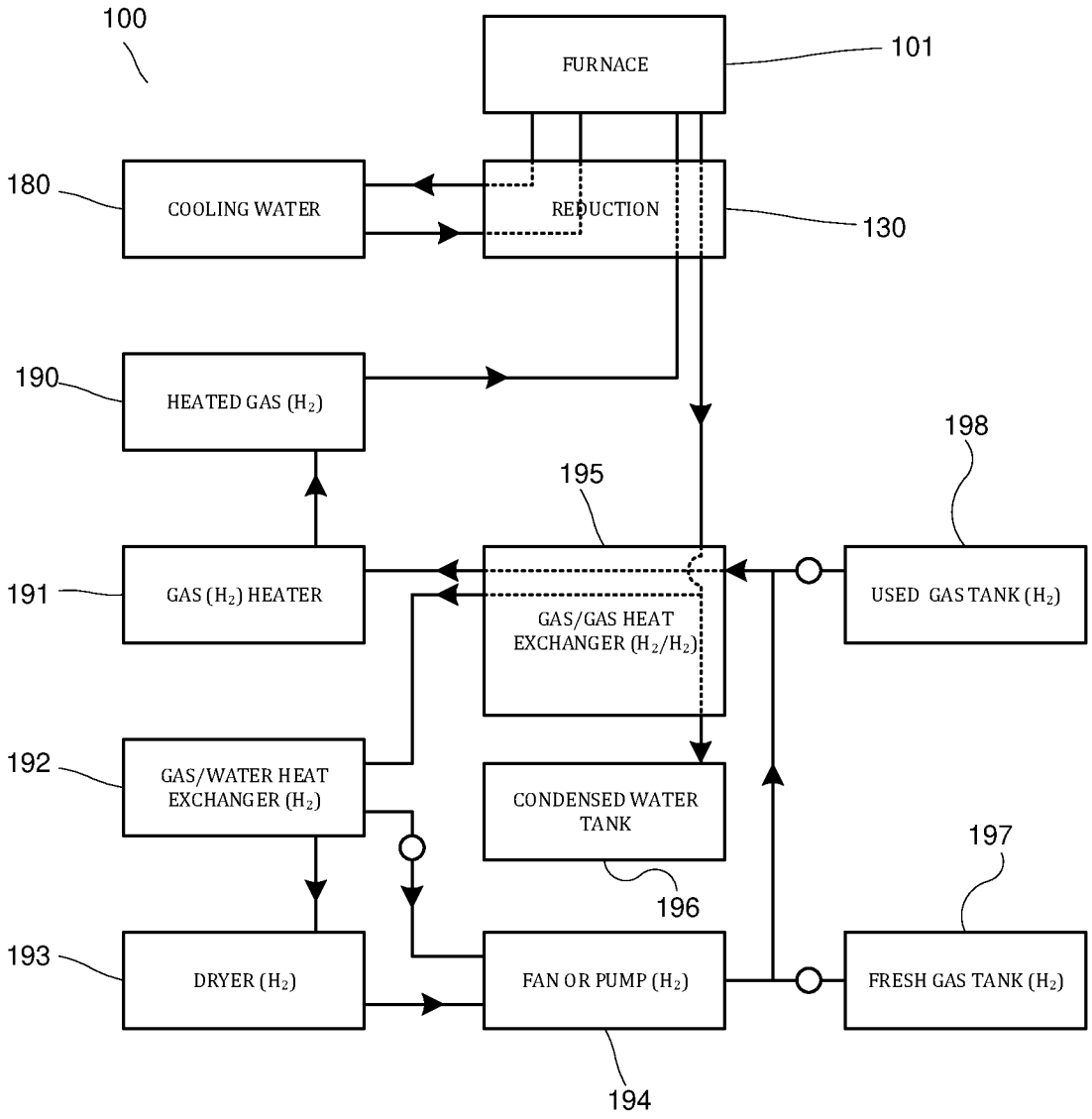
FIG. 4 is an overview corresponding to FIG. 1 but specifically illustrating a flow of hydrogen gas for reduction of a charged metal material.

The reduction step is illustrated in closer detail in FIG. 4. The reduction uses hydrogen gas, as opposed to said inert gas, and is heated in a separate hydrogen gas heater 191. This heater 191 is also used to maintain a desired hydrogen gas temperature, noting that the reduction of the metal material 106 is an endothermic chemical reaction.

Preferably, pure or substantially pure hydrogen gas is used.

The reduction step also features a gas/gas heat exchanger 195, for transfer of heat from the hydrogen gas flowing out from the connected mobile furnace 101 to hydrogen gas 190 flowing into the mobile furnace 101. The reduction reaction produces water in the form of water vapour, and this water vapour is condensed in gas/gas heat exchanger 195. To further decrease water contents in the hydrogen gas, it may be further cooled in a connected gas/water heat exchanger 192, and a gas dryer 193 may also be used. The hydrogen gas is circulated using a fan or pump 194, and is heated by gas heater 191 (that may be an electric heater of the above-described type).

In general, the reduction step may comprise heat exchanging hydrogen gas exiting from the mobile furnace 101 to hydrogen gas entering the mobile furnace 101, to cool and dry the heat exchanged hydrogen gas, and further to collect liquid water formed from said drying.

During reduction, hydrogen gas is consumed, and is therefore replenished, up to a desired pressure, from a controlled storage for used/fresh hydrogen gas 197, 198. The desired pressure may, again, be between 1.0 and 1.5 bars, such as between 1.0 and 1.1 bars.

The reduction velocity can be controlled by the control unit 20 controlling an amount hydrogen gas passing per time unit through the material 106 in the connected mobile furnace 101, and/or the control unit 20 controlling a selected overpressure of said hydrogen gas.

All condensed water is collected in a condensed water tank 196. The amount of water in tank 196 may be measured by a suitable level sensor, and used by control device 20 to determine a total amount of reduced metal material 106.

When the reduction has been completed of the metal material 106, the circulation pump or fan 194 is switched off, as well as the heater 191. Cooling water and hydrogen gas supply valves are closed off by valve system 13 at the connection station 130. Any other stationary equipment at the connection station 130 may be temporarily switched off until the next mobile furnace 101 arrives at the station 130. The condensed water tank 196 may be emptied.

Preferably, the mobile furnace 101 is then moved to the sintering/carburisation connection 140 station with maintained hydrogen gas pressure inside the furnace space 101*a*, in order to minimise reoxidation of the metal material 106.

When connected to the sintering/carburisation connection station 140, the atmosphere circulated by the system 100 in the mobile furnace 101 is also hydrogen gas, or at least comprises hydrogen gas as a subcomponent. As is shown in FIG. 5, the system 100 uses elements 180, 190, 191, 193, 194, 195, 197, 198 in a corresponding manner as is shown in FIG. 4. It is realized that each one of these components may be the same or additional to those correspondingly shown in FIG. 4, depending on mode of operation of the system 100. Namely, the reduction 130 and sintering 140 stations may be arranged to work simultaneously or one at a time.

In general, the hydrogen gas flowing out from the reduction connection station 130, typically holding 650-750° C., can be used for sintering after its temperature has been raised, using gas heater 191, to a desired sintering temperature, such as between 850-950° C.

In the preferred case in which the hydrogen gas is mixed with a carbon-containing gas, such as $CH_4$ provided from $CH_4$ fresh gas tank 200, it is desired to use a separate circuit for the sintering gas as compared to the reduction gas circuit, but where the energy from the reduction step is exploited by reusing reduction-step used heated hydrogen gas as input to the sintering step, the circuits can in some cases be interconnected.

In some embodiments, the sintering can be performed first by circulating only hot hydrogen gas in the closed-loop circuit illustrated in FIG. 5, and thereafter performing the carburisation by also adding carbon-containing gas to the circulation. Thereafter, the circuit can be emptied of gas 201, using vacuum pump 202 to used gas storage 202, and replace the hydrogen/carburisation gas for inert gas such as nitrogen gas, before the next mobile furnace 101 is connected to the station 140 and hydrogen gas is again circulated in the circuit.

When leaving the connection station 140, the mobile furnace 101 furnace space 101*a* is preferably also filled with an inert gas, such as nitrogen gas, in preparation for the cooling processing step 150-151.

As mentioned above, the present invention further relates to the system 100 as such, which, like the present method is arranged for producing direct reduced metal material 106 in a continuous process of the type generally described herein. The system comprising circulation means 194 for circulating hydrogen gas in the closed-loop first gas circuit; said first valve system; circulation means 172, 174, arranged to circulate an inert gas in the closed-loop second gas circuit; said second valve system; and a plurality of individual mobile furnaces 101 of the type described herein.

Then, the system 100 may be arranged to perform a series of automatically performed steps, corresponding to the steps described herein in relation to the present method. In general, these steps are performed under the control of control device 20 and using the automatic processing equipment described and exemplified herein. In particular, the system 100 is arranged to:

- charge an amount of metal material 106 to be reduced into a mobile furnace 101;
- move the mobile furnace 101 to, and connect the mobile furnace 101 to, a first one of said inert gas connection stations 120-122, 150-151;
- provide heated inert gas to the mobile furnace 101 so that the metal material 106 is heated by the heated inert gas circulating past the metal material 106 inside the mobile furnace 101;
- disconnect the mobile furnace 101 from said first inert gas connection station;

move the mobile furnace 101 to, and connecting the mobile furnace 101 to, a first one of said hydrogen gas connection stations 130, 140;

provide heated hydrogen gas to the mobile furnace 101 so that the metal material 106 is reduced by the heated hydrogen gas circulating past the metal material 106 inside the mobile furnace 101;

disconnect the mobile furnace 101 from said first hydrogen gas connection station 130, 140;

move the mobile furnace 101 to, and connecting the mobile furnace 101 to, a second one of said inert gas connection stations 120-122, 150-151;

provide cooled inert gas to the mobile furnace 101 so that the metal material 106 is cooled by the cooled inert gas circulating past the metal material 106 inside the mobile furnace 101;

disconnect the mobile furnace 101 from said second inert gas connection station 120-122, 150-151; and discharge the reduced and cooled metal material 106 from the mobile furnace 101.

Above, preferred embodiments have been described. However, it is apparent to the skilled person that many modifications can be made to the disclosed embodiments without departing from the basic idea of the invention.

For instance, the system 100 may comprise additional processing steps, apart from the ones described herein. The mobile furnaces 101 may also vary in terms of design and functionality, apart from what has been described herein.

All which has been said in relation to the present method is equally applicable to the present system, and vice versa.

Hence, the invention is not limited to the described embodiments, but can be varied within the scope of the enclosed claims.

The invention claimed is:

1. A method for producing direct reduced metal material in a continuous process, the method comprising circulating hydrogen gas in a closed-loop first gas circuit by, using a first valve system for selectively circulating the hydrogen gas via one or more of a set of hydrogen gas connection stations, the method further comprising circulating an inert gas in a closed-loop second gas circuit by, using a second valve system for selectively circulating the inert gas via one or more of a set of inert gas connection stations, wherein the method further comprises the following steps performed separately for each one of a plurality of individual mobile furnaces:

a) charging an amount of metal material to be reduced into said each mobile furnace;

b) moving said each mobile furnace to, and connecting said each mobile furnace to, a first one of said set of inert gas connection stations;

c) providing heated inert gas to said each mobile furnace so that the metal material is heated by the heated inert gas circulating past the metal material inside said each mobile furnace;

d) disconnecting said each mobile furnace from said first one of said set of inert gas connection stations;

e) moving said each mobile furnace to, and connecting said each mobile furnace to, a first one of said set of hydrogen gas connection stations;

f) providing heated hydrogen gas to said each mobile furnace so that the metal material is reduced by the heated hydrogen gas circulating past the metal material inside said each mobile furnace;

g) disconnecting said each mobile furnace from said first one of said set of hydrogen gas connection stations;

h) moving said each mobile furnace to, and connecting said each mobile furnace to, a second one of said set of inert gas connection stations;

i) providing cooled inert gas to said each mobile furnace so that the metal material is cooled by the cooled inert gas circulating past the metal material inside said each mobile furnace;

j) disconnecting said each mobile furnace from said second one of said set of inert gas connection stations; and k) discharging the reduced and cooled metal material from said each mobile furnace.

2. The method according to claim 1, wherein at least one of said hydrogen gas or said inert gas is circulated at atmospheric pressure or at the most 1.5 bars.

3. The method according to claim 1, wherein the inert gas used to cool the metal material in step i is recycled to preheat or heat the metal material in step c.

4. The method according to claim 1, wherein the method further comprises preheating the inert gas used to heat the metal material in step c using a heater provided upstream of the first of said set of inert gas connection stations and/or preheating the hydrogen gas used in step f using a heater provided upstream of the first one of set of hydrogen gas connection stations.

5. The method according to claim 4, wherein said each mobile furnace is passive in terms of heat provision, in the sense that said each mobile furnace does not comprise an integrated source of thermal energy.

6. The method according to claim 1, wherein, during performance of steps a-k, at least one of said heated inert gas, said hydrogen gas, or said cooled inert gas is provided in the respective steps c, f, or i to flow into said each mobile furnace and past the metal material from below the metal material upwards in said each mobile furnace.

7. The method according to claim 1, wherein each of the mobile furnaces includes two furnace parts, arranged to engage with each other to form a closed furnace space, wherein at least one of said two furnace parts is water-cooled, wherein the method comprises circulating cooling water in a cooling water circuit, and wherein said hydrogen gas and/or inert gas connection stations include connections for said cooling water so that during the performance of steps a-k said each mobile furnace, when connected to said connection station in question, is provided with such circulating cooling water.

8. The method according to claim 1, wherein the method further comprises controlling, using a fan or pump the speed of which can be controlled, a circulation velocity in said first and/or second gas circuit so that heat supplied to the metal material, reduction velocity of the metal material, and/or cooling supplied to metal material is controlled.

9. The method according to claim 1, wherein step f further comprises continuing the provision of the heated hydrogen gas to further sinter the metal material after the metal material has been reduced.

10. The method according to claim 1, wherein the method further comprises circulating a carbon-containing gas in a closed-loop third gas circuit by, using a third valve system, selectively circulate said carbon-containing gas via one or several of said set of several hydrogen gas connection stations, and wherein step f further comprises providing said carbon-containing gas to said each mobile furnace so that the metal material is carburised by the carbon-containing gas circulating past the metal material inside said each mobile furnace.

11. The method according to claim 1, wherein the method further comprises circulating a carbon-containing gas in a closed-loop third gas circuit by, using a third valve system, selectively circulate said carbon-containing gas via one or several of a set of several carbon-containing gas connection stations, and wherein the performance of steps a-k further comprises the following steps separately performed after step g but before step h:

moving said each mobile furnace to, and connecting said each mobile furnace to, a first one of said set of carbon-containing gas connection stations; providing said carbon-containing gas to said each mobile furnace so that the metal material is carburised by the carbon-containing gas circulating past the metal material inside said each mobile furnace; and disconnecting said each mobile furnace from said first carbon-containing gas connection station.

12. The method according to claim 1, wherein the method further comprises using more inert gas connection stations in parallel and/or in series than a number of hydrogen gas connection stations being used in parallel and/or in series.

13. The method according to claim 1, wherein several of said inert gas connection stations are used at the same time with several of the plurality of mobile furnaces in parallel, and wherein the method comprises circulating at least one of the heated inert gas or the cooled inert gas in a direction opposite to a process flow of the several of the plurality of mobile furnaces, past said several of the plurality of mobile furnaces in series, and then move said several of the plurality of mobile furnaces in said process flow between said inert gas connection stations one by one by disconnecting from one of said inert gas connection stations, moving the disconnected mobile furnace and connecting to a next one of said inert gas connection stations.

14. The method according to claim 1, wherein step f further comprises heating the metal material past a melting and/or evaporation temperature for a contaminant present in the metal material, using the heated hydrogen gas as heat source for said heating.

15. The method according to claim 1, wherein step a comprises charging a basket filled with metal material to be reduced into a furnace space of said each mobile furnace, and wherein k comprises discharging said basket from said furnace space.

16. The method according to claim 1, wherein step f comprises heat exchanging hydrogen gas exiting from said each mobile furnace to hydrogen gas entering said each mobile furnace, to cool and dry the heat exchanged hydrogen gas, and further to collect liquid water formed from said drying.

17. A system for producing direct reduced metal material in a continuous process, the system comprising a hydrogen gas circulation fan or pump for circulating hydrogen gas in a closed-loop first gas circuit, the system comprising a first valve system, arranged to selectively circulate the hydrogen gas via one or more of a set of hydrogen gas connection stations the system further comprising an inert gas circulation fan or pump, arranged to circulate an inert gas in a closed-loop second gas circuit; a second valve system, arranged to selectively circulate the inert gas via one or more of a set of inert gas connection stations, wherein the system further comprises a plurality of individual mobile furnaces, being arranged to:

a) charge an amount of metal material to be reduced into a selected mobile furnace from the plurality of individual mobile furnaces;
b) move the selected mobile furnace to, and connect the selected mobile furnace to, a first one of said set of inert gas connection stations;
c) provide heated inert gas to the selected mobile furnace so that the metal material is heated by the heated inert gas circulating past the metal material inside the selected mobile furnace;
d) disconnect the selected mobile furnace from said first one of said set of inert gas connection stations;
e) move the selected mobile furnace to, and connecting the selected mobile furnace to, a first one of said set of hydrogen gas connection stations;
f) provide heated hydrogen gas to the selected mobile furnace so that the metal material is reduced by the heated hydrogen gas circulating past the metal material inside the selected mobile furnace;
g) disconnect the selected mobile furnace from said first one of said set of hydrogen gas connection stations;
h) move the selected mobile furnace to, and connecting the selected mobile furnace to, a second one of said set of inert gas connection stations;
i) provide cooled inert gas to the selected mobile furnace so that the metal material is cooled by the cooled inert gas circulating past the metal material inside the selected mobile furnace;
j) disconnect the selected mobile furnace from said second one or said inert gas connection stations; and
k) discharge the reduced and cooled metal material from the selected mobile furnace.

* * * * *